US006823167B1

(12) United States Patent
Gross et al.

(10) Patent No.: US 6,823,167 B1
(45) Date of Patent: Nov. 23, 2004

(54) PAPER SENSITIVE SPRING LOADED PREFUSER PAPER GUIDE

(75) Inventors: Robert A. Gross, Penfield, NY (US); Youti Kuo, Penfield, NY (US); Mark Stevens, Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 28 days.

(21) Appl. No.: 10/427,509

(22) Filed: Apr. 30, 2003

(51) Int. Cl.[7] ..... G03G 15/20
(52) U.S. Cl. ..... 399/400; 399/397; 399/322
(58) Field of Search ..... 399/322, 400, 399/397, 401

(56) References Cited

U.S. PATENT DOCUMENTS 6,169,874 B1 * 1/2001 Quesnel et al. ..... 399/400
2003/0118357 A1 * 6/2003 Fromm et al. ..... 399/21

OTHER PUBLICATIONS

Pub. No. US 2002/0076228 published Jun. 20, 2002.

* cited by examiner

*Primary Examiner*—Andrew H. Hirshfeld
*Assistant Examiner*—Kevin D. Williams
(74) *Attorney, Agent, or Firm*—Perman & Green, LLP

(57) ABSTRACT

A guide system for xerographic printing apparatus introduces paper bearing an unfixed image and having a broad range of basis weights into a fuser nip from a prefuser transport without causing image smear. An entrance baffle is positioned in the path of the paper advancing toward the fuser nip for engagement by the paper's leading edge. The entrance baffle is hinged at its mounting end for swinging movement between a maximal and minimal positions as defined by stop members and is biased into engagement with the minimal stop member. The magnitude of the bias is chosen such that as the lightest basis weight paper engages the entrance baffle, it bends around its free end and is guided into the fuser nip, and such that as the heaviest paper engages the entrance baffle, it forces the entrance baffle toward engagement with the second stop member and itself is guided into the fuser nip.

10 Claims, 7 Drawing Sheets

PAPER SENSITIVE SPRING LOADED PREFUSER PAPER GUIDE

BACKGROUND OF THE INVENTION

1. Field of the Invention

The present invention relates generally to improved sheet feeding and, more specifically, to eliminating image smear, regardless of paper basis weight, in the transfer zone between a prefuser transport and a fuser nip.

2. Description of the Prior Art

In a paper path of a xerographic printing system, positions and profiles of baffles are designed to guide the movement of substrates into functional areas of various subsystems. A typical paper path includes passages from a feeder, through registration, image transfer, prefuser transport, by a fuser entrance baffle into a fuser, then exiting to an output tray. Robust paper handling in the paper path must be performed in a manner which ensures motion quality without image smear and paper jams. However, it is a substantial design challenge for a paper path capable of handling a wide range of substrate sizes and basis weights to meet stringent image quality requirements. It may be preferable to use a sensor system for enabling the adjustments of the paper path parameters according to detected substrate characteristics but such an intelligent system is very costly by reason of the added necessary sensors and other required electrical/mechanical components.

A disclosure relating generally to the field of concern of the instant invention is found in commonly assigned U.S. Patent Application Publication No. US 2002/0076228 to Less et al. although the problem solved by that invention is different from the problem which is of concern to the present invention.

In order to meet copy quality goals for a range of paper weights, paper path control is essential. To avoid adverse effects of paper wrinkle and image deletions, the paper needs to be bent around the prefuser paper guide exit. To avoid image smear with lightweight paper tangency control to the fuser nip is required. Unfortunately this treacherous paper path requirement will result, especially, in heavyweight paper handling problems. There is a different set of geometric paper path control requirements for heavyweight paper than for lightweight paper.

It was with knowledge of the foregoing state of the technology that the present invention has been conceived.

SUMMARY OF THE INVENTION

A guide system for xerographic printing apparatus introduces paper bearing an unfixed image and having a broad range of weights into a fuser nip from a prefuser transport without causing image smear. In one embodiment, a baffle member is positioned in the path of the paper advancing toward the fuser nip for engagement by the paper's leading edge. The baffle member is hinged at its mounting end for swinging movement between a maximal and minimal positions as defined by stop members and is biased into engagement with the minimal stop member. The magnitude of the bias is chosen such that as the lightest weight paper engages the baffle member, it bends around its free end and is guided into the fuser nip, and such that as heavy paper engages the baffle member, it forces the baffle member toward engagement with the second stop member and itself is guided into the fuser nip.

The proposed design concept is to have paper stiffness determine the geometric position of the prefuser paper guide to minimize heavyweight paper lead edge paper impact when contacting the prefuser guide. Maximal and minimal stops are used to control the full range of paper guide movement.

In one instance, as noted, a prefuser paper guide is spring loaded and self adjusting with positioning stops to control the paper path in the region of concern and thereby enables handling a wide range of paper basic weights and sizes without paper handling failures including jams, paper stall, smear and the like while still meeting required critical parameters for paper fusing, that is, avoiding wrinkles, image deletions, smear, and the like.

In short, then, in this particular embodiment, a self-adjusting spring loaded prefuser paper guide is provided to reduce image disturbances that occur when stiff papers are used. The image disturbances are introduced when a stiff sheet contacts the baffle that directs paper from the prefuser transport into the fuser nip, propagating part of the impact force back into the xerographic transfer area. The proposed guide features spring loaded fingers that deflect more for stiff papers than for thin papers, modifying the paper path and absorbing some of the impact force. The benefit which is achieved enables a wide latitude of paper stiffness.

In another instance, a mechanism for eliminating image smear of heavy weight sheets in the transfer zone is achieved by installing self-adjusting guide fingers on the upstream portion of the fuser entrance baffle for softening the impact force of the heavy weight sheets when hitting the baffle such that the images in the transfer zone not be disturbed. More specifically, self-adjusting fingers are incorporated into the prefuser entrance baffle for increasing the paper handling latitude for a large range of light weight and heavy weight papers, such as from 45 to 285 gsm paper basis weight. A plurality of spring-loaded fingers are positioned near the paper landing position in the upstream portion of the fuser entrance baffle. There are slot openings in the corresponding locations of the baffle for accommodating the angular movement of the fingers crossing the baffle. The stiffness of torsion springs is chosen with little deflection of the fingers by the light weight sheets while accommodating significant deflections upon contact by heavy basis weight sheets. The deflection of the fingers softens the contact force, and therefore, with less adverse effect on image quality at the transfer zone. With respect to a given optimized baffle geometry guiding sheets into the fuser nip, the position and the deflection of the fingers can be designed so as not to adversely affect the entry of the sheets into the fuser nip.

In short, then, this alternate embodiment also corrects image disturbances which are introduced when stiff papers contact the baffle that, directs paper from the prefuser transport into the fuser nip, propagating part of the impact force back into the xerographic transfer area. This proposed guide features spring loaded fingers that deflect more for stiff papers than for thin papers, modifying the paper path and absorbing some of the impact force. The resulting benefit of this construction is that printing can occur with excellent image quality on sheet paper having a broad latitude of stiffness.

A primary feature, then, of the present invention is the provision of xerographic printing apparatus provided with improved sheet movement in transfer, prefuser transport, fuser paper path.

Another feature of the present invention is the provision of such a system which operates to eliminate image smear, regardless of paper basis weight, in the transfer zone, between a prefuser transport and a fuser nip.

Yet another feature of the present invention is the provision of such a system for introducing paper having an unfixed image thereon and having a predetermined range of basis weights between a lightest basis weight and a heaviest basis weight into a fuser nip from a prefuser transport and without causing image smear on the paper.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
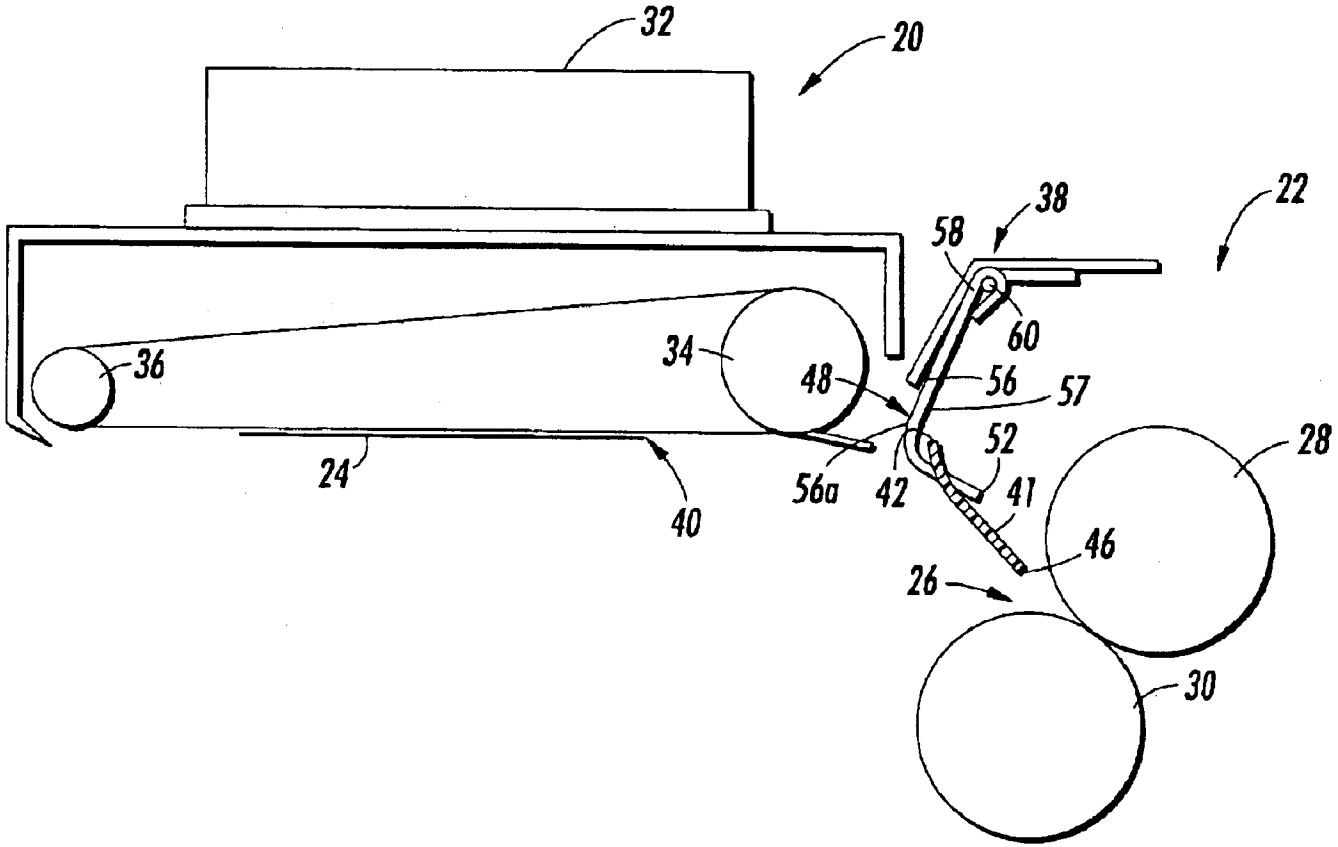
FIG. 1 is a diagrammatic side elevation view illustrating a portion of apparatus for transporting paper having an unfixed image thereon and having a predetermined range of weights between a lightest weight and a heaviest weight into a fuser nip from a prefuser transport including a guide system embodying the invention.
Figure 2:
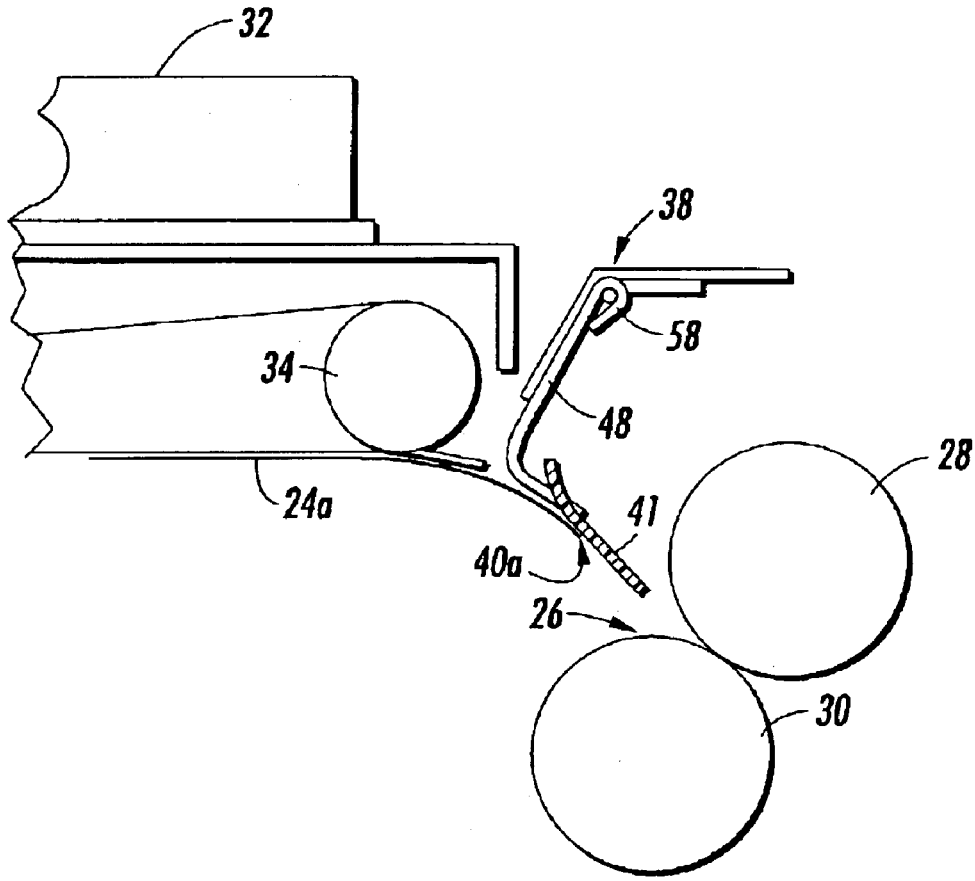
FIG. 2 is a detail diagrammatic side elevation view of a portion of the apparatus illustrated in FIG. 1 with a stationary entrance baffle and a self-adjusting guide in an un-deflected position.
Figure 3:
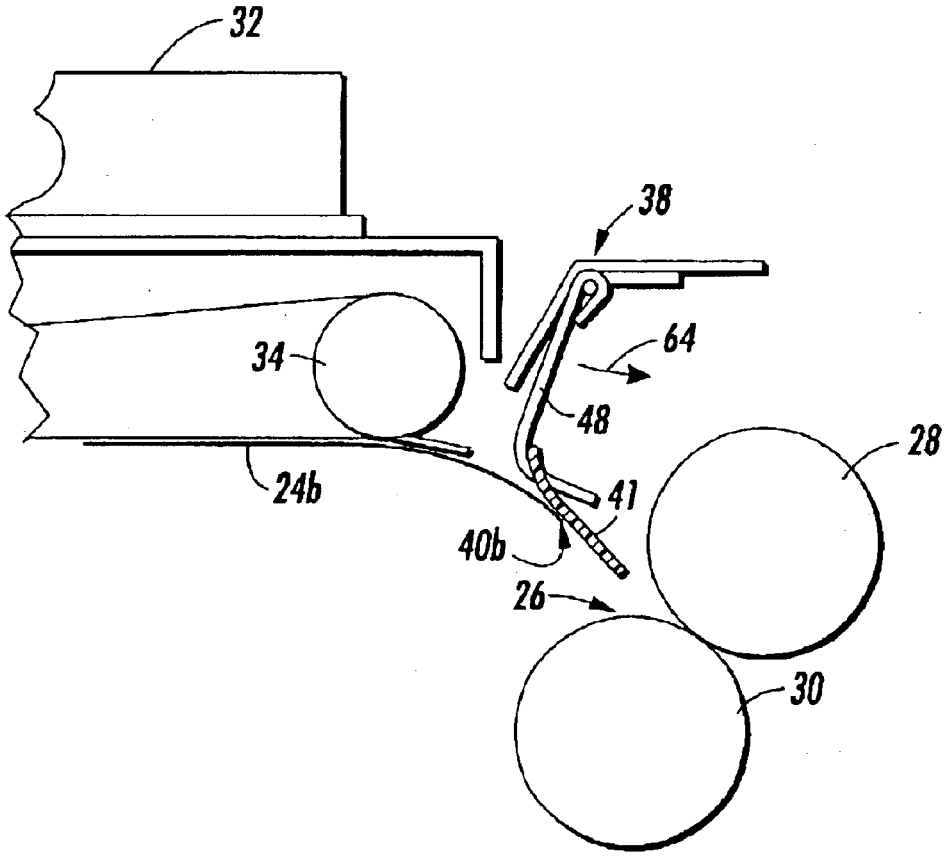
FIG. 3 is a detail diagrammatic side elevation view of a portion of the apparatus illustrated in FIG. 1 with a stationary entrance baffle and a self-adjusting guide in a deflected position.
Figure 4:
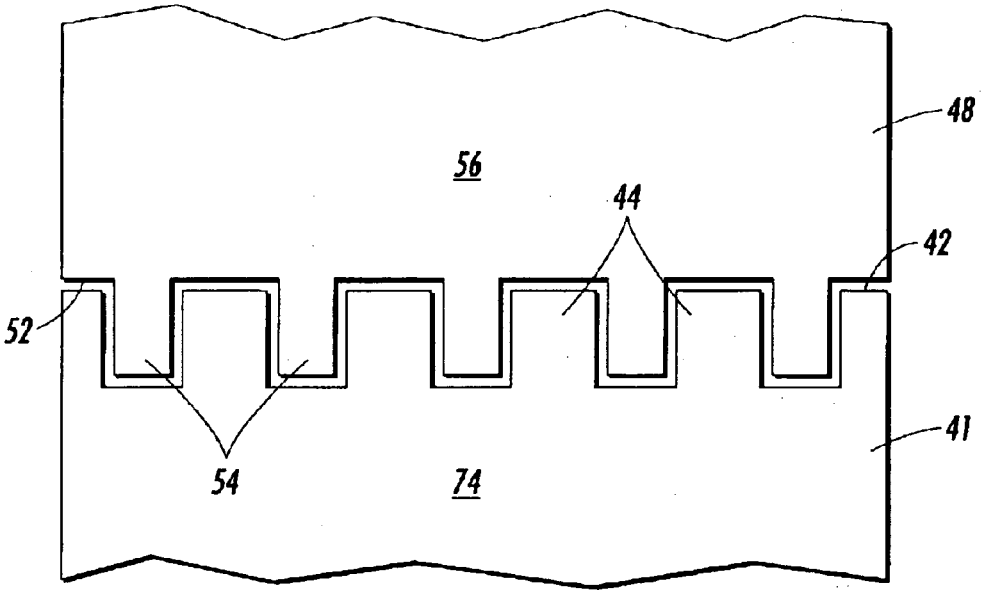
FIG. 4 is a detail diagrammatic front elevation view of the engagement of cooperating components illustrated in FIGS. 1, 2, and 3.

Turn now to the drawings and, initially, to FIG. 1 which generally illustrates xerographic printing apparatus 20 with a guide system 22 for introducing paper 24 having an unfixed image thereon and having a predetermined range of basis weights between a lightest weight and a heaviest weight into a fuser nip 26 defined by cooperating pressure roll 28 and fuser roll 30 from a prefuser transport 32 including a driver roller 34 and an idler roller 36. Although the present invention will be described with reference to the embodiments shown in the drawings, it should be understood that the present invention can be embodied in many alternate forms or embodiments. In addition, any size, shape or type of elements or materials suitable for the invention might be used.

According to the invention, a baffle system 38 is positioned intermediate the prefuser transport 32 and the fuser nip 26 so as to be in the path of the paper 24 as it advances toward the fuser nip for engagement by a leading edge 40 of the paper. As will be described, the baffle system 38 is adjustable in response to the basis weight of the paper 24 to properly guide the leading edge 40 of the paper into the fuser nip 26.

Viewing now FIG. 1 together with FIGS. 2, 3, 4 and 5, the baffle system 38 includes a stationary entrance baffle 41 extending between an upstream end 42 formed with a plurality of laterally spaced first finger members 44 distant from the fuser nip 26 and a downstream end 46 adjacent the fuser nip.

A self-adjusting guide member 48 extends between a mounting end 50 and a free end 52 formed with a plurality of laterally spaced second finger members 54 positioned for interdigitating movement relative to the first finger members 44. The guide member is also formed with a planar front surface 56 contoured to have a laterally extending nose portion 56*a* facing the leading edge 40 of the paper 24 as it advances toward the fuser nip 26 as well as a rear surface 57 facing away from the oncoming paper.

Figure 5:
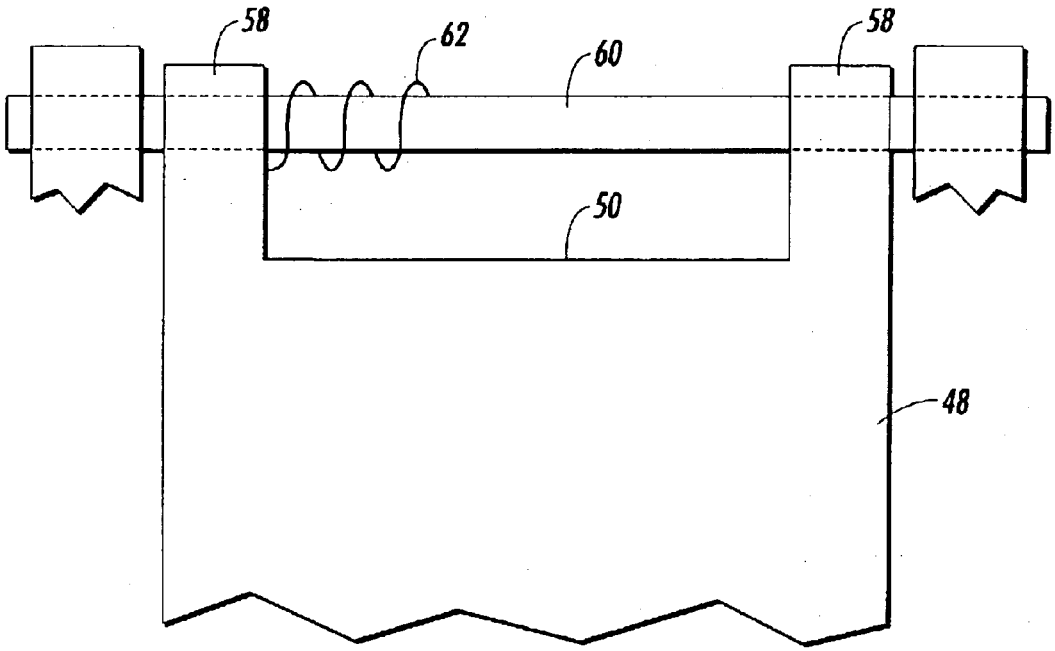
FIG. 5 is a detail diagrammatic front elevation view of the pivotal engagement of the self-adjusting guide illustrated in FIGS. 1, 2, and 3.

A hinge member 58 pivotally supports the self-adjusting guide member 48 at its mounting end 50 for swinging movement on a mounting bar 60 between a minimal position (FIG. 2) and a maximal position (FIG. 3) of a range of positions as determined by the weight of the paper. As seen in FIG. 5, actually a pair of spaced apart hinge members 58 are provided for the purpose of supporting the guide member. A suitable resilient member is illustrated as a torsion spring 62 fixed at its opposite ends to the support bar 60 and to the guide member 48. A variety of other resilient members may be used in place of the torsion spring 62. In this instance, the torsion spring has a stiffness sufficient to generally hold the guide member positioned in a quiescent state such that as a leading edge 40*a* of paper 24*a* having the lightest weight in the predetermined range engages the nose portion 56 of the self-adjusting guide member 48, it properly guides the leading edge of the paper along the entrance baffle 41 and into the fuser nip 26 and such that as a leading edge 40*b* of paper 24*b* having the heaviest weight in the predetermined range engages the nose portion 56 of the self-adjusting guide member 48, it yields and swings in a direction away, as indicated by arrow 64, from the oncoming paper according to the weight of the paper and properly guides the leading edge of the paper along the entrance baffle and into the fuser nip.

Figure 6:
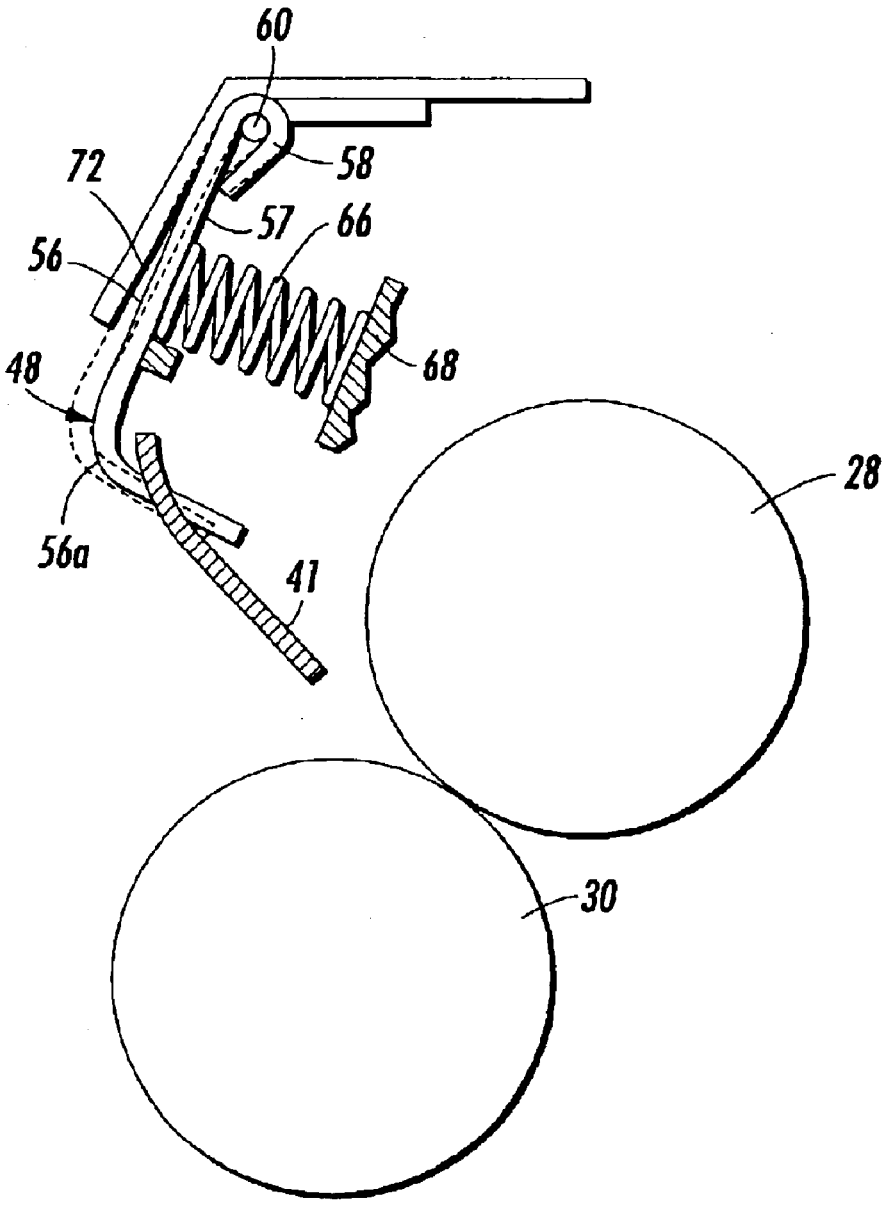
FIG. 6 is a detail diagrammatic side elevation view of a spring-loaded self-adjusting guide of the apparatus illustrated in FIGS. 1, 2, and 3.

It was earlier noted that the guide member 48 has a planar front surface 56 including the nose portion 56*a* facing the oncoming paper 24 and a rear surface 57 facing away from the oncoming paper. In an alternate construction of the resilient member, a compression spring 66 is provided which, as seen in FIG. 6, extends between the frame 68 of the printing apparatus 20 and the rear surface 57 of the guide member 48 and maintains the front surface 56 of the guide member in the quiescent state, engaged with a minimal stop member as indicated by dashed lines. A maximal stop member 72 integral with the frame of the printing apparatus 20 is also provided for engagement by the guide member 48 (as seen in FIG. 6) to define the maximal position.

The stationary entrance baffle 41 has a generally planar front surface 74 which is effectively a continuation of the front surface 56 of the self-adjusting guide member 48 throughout the range of swinging movement of the guide member between the minimal position defined by the stop member 70 and the maximal position defined by the stop member 72.

Figure 7:
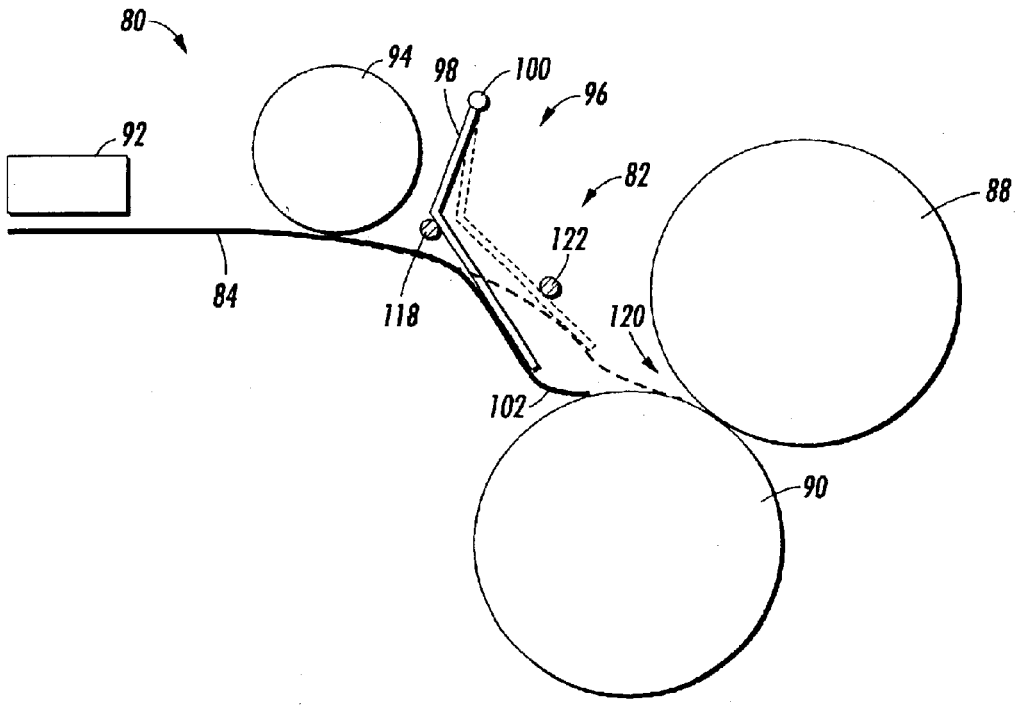
FIG. 7 is a diagrammatic side elevation view of an another embodiment of a pivotal entrance baffle positioned between a prefuser transport and a fuser nip.
Figure 8:
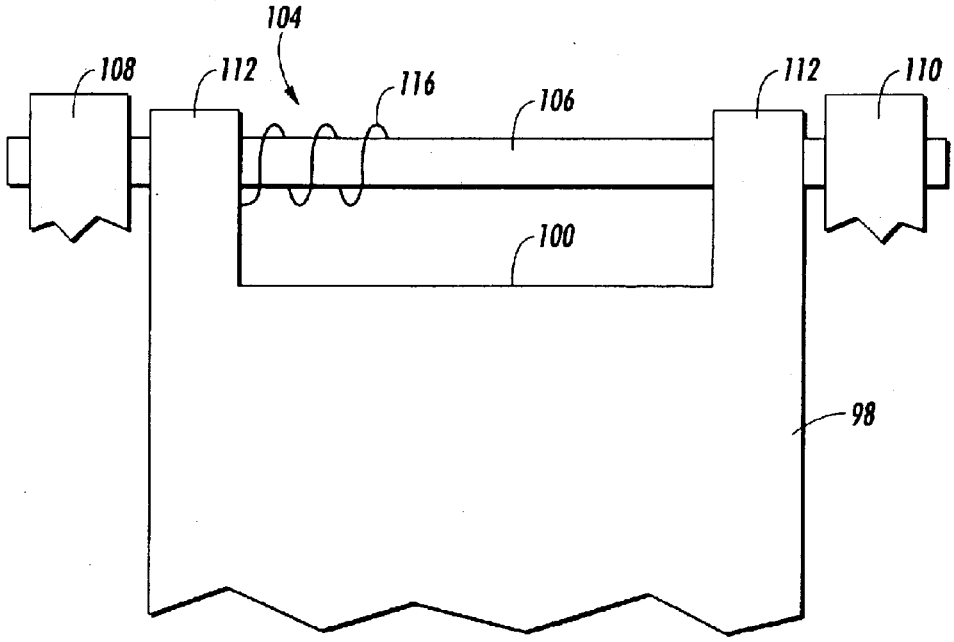
FIG. 8 is a detail diagrammatic front elevation view of a hinge support of a pivotal entrance baffle as illustrated in FIG. 7.

Turn now to FIGS. 7 and 8 for the description of another embodiment of the invention. In this instance, again, xerographic printing apparatus 80 is provided with a guide system 82 for introducing paper 84 having an unfixed image thereon and having a predetermined range of weights between a lightest weight and a heaviest weight into a fuser nip 86 defined by cooperating pressure roll 88 and fuser roll 90 from a prefuser, transport 92 including a driver roller 94.

In this instance, a baffle system 96 includes an pivotal entrance baffle 98 extending between a mounting end 100 and a free end 102. A hinge member 104 pivotally supports the entrance baffle 98 at its mounting end for swinging movement between a minimal position (as depicted by solid lines in FIG. 7) and a maximal position (as depicted by dashed lines in FIG. 7) of a range of positions as determined by the weight of the paper 84. The hinge member 104 includes a mounting bar 106 extending between spaced apart support elements 108, 110 of the printing apparatus 80. For this purpose, also, the pivotal entrance baffle 98 includes a pair of spaced apart perforated ears 112 at its mounting end 100 slidably received on the mounting bar 106.

Additionally, a resilient member 114 which may include a torsion spring 116, or other suitable construction, extends between one end fixed to one of the perforated ears 112 and an opposite end fixed to the bar 106. Under the bias of the torsion spring 116, the entrance baffle 98 is normally urged into engagement with a minimal stop member 118, the bias of the spring being chosen such that as the leading edge of paper having the lightest weight in the predetermined range engages the entrance baffle, it is caused to wrap around the free end 102 and thereby be guided into a fuser nip 120 defined by the pressure roll 88 and fuser roll 90. Further, as a leading edge of paper having the heaviest weight in the predetermined range engages the entrance baffle 98, it forces the entrance baffle against the bias of the spring 116 toward engagement with a second, or maximal, stop member 122 (as indicated by dashed lines in FIG. 7) and is guided by the free end 102 of the entrance baffle into the fuser nip.

Figure 9:
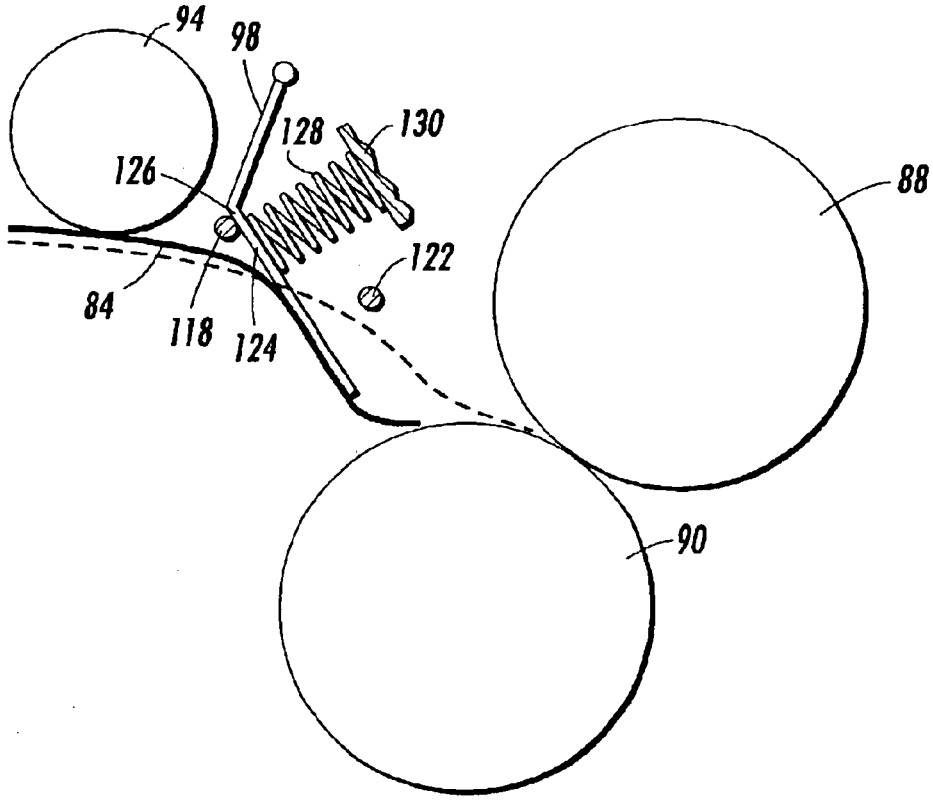
FIG. 9 is a detail diagrammatic side elevation view of another embodiment of a spring-loaded pivotal entrance baffle as illustrated in FIGS. 7 and 8.

As seen especially well in FIG. 9, another embodiment of the resilient member will now be described. The entrance baffle 98 has a front surface 124 facing the oncoming paper 84 and a rear surface 126 facing away from the oncoming paper. Further, in this instance, a modified resilient member includes a compression spring 128 extends between a frame 130 of the printing apparatus 80 and the rear surface of the entrance baffle 98 and urges the front surface 124 of the entrance baffle into engagement with the minimal stop member 118.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. In a xerographic printing apparatus, a guide system for introducing paper having an unfixed image thereon and having a predetermined range of basis weights between a lightest basis weight and a heaviest basis weight into a fuser nip from a prefuser transport, the guide system comprising:

a baffle system intermediate the prefuser transport and the fuser nip positioned in the path of the paper as it advances toward the fuser nip for engagement by a leading edge of the paper, the baffle system being adjustable in response to the basis weight of the paper to properly guide the leading edge of the paper into the fuser nip;

wherein the baffle system includes:

an entrance baffle extending between a mounting end and a free end;

a hinge member pivotally supporting the entrance baffle at its mounting end for swinging movement between a minimal position and a maximal position of a range of positions as determined by the basis weight of the paper;

a minimal stop member for engagement by the entrance baffle to define the minimal position;

a maximal stop member for engagement by the entrance baffle to define the maximal position; and a resilient member biasing the entrance baffle into engagement with the minimal stop member, the bias of the spring being chosen such that as the leading edge of paper having the lightest basis weight in the predetermined range engages the entrance baffle, it is caused to bend around the free end thereof and thereby be guided into the fuser nip, and such that as the leading edge of paper having the heaviest basis weight in the predetermined range engages the entrance baffle, it forces the entrance baffle against the bias of the spring toward engagement with the second stop member and is guided by the free end of the entrance baffle into the fuser nip.

2. A guide system as set forth in claim 1 wherein the resilient member is a spring.

3. A guide system as set forth in claim 1 wherein the hinge member includes a mounting bar extending between spaced apart support elements of the printing apparatus;

wherein the entrance baffle includes a pair of spaced apart perforated ears at its mounting end slidably received on the mounting bar; and wherein the resilient member includes a torsion spring extending between one end fixed to one of the perforated ears and an opposite end fixed to the bar.

4. A guide system as set forth in claim 1 wherein the entrance baffle has a front surface facing the oncoming paper and a rear surface facing away from the oncoming paper; and wherein the resilient member includes a compression spring extending between the frame of the printing apparatus and the rear surface of the entrance baffle and urging the front surface of the entrance baffle into engagement with the first stop member.

5. A guide system as set forth in claim 1 wherein the baffle system includes:

a stationary entrance baffle extending between an upstream end formed with a plurality of laterally spaced first finger members distant from the fuser nip and a downstream end adjacent the fuser nip;

a self-adjusting guide member extending between a mounting end and a free end formed with a plurality of laterally spaced second finger.members positioned for interdigitating movement relative to the first finger members, the guide member formed with a laterally extending nose portion facing the leading edge of the paper as it advances toward the fuser nip;

a hinge member pivotally supporting the self-adjusting guide member at its mounting end for swinging movement between a minimal position and a maximal position of a range of positions as determined by the basis weight of the paper; and a resilient member being of a stiffness to generally hold the guide member positioned in a quiescent state such that as the leading edge of paper having the lightest basis weight in the predetermined range engages the nose portion of the self-adjusting guide member, it properly guides the leading edge of the paper along the entrance baffle and into the fuser nip and such that as the leading edge of paper having the heaviest basis weight in. the predetermined range engages the nose portion of the self-adjusting guide member, it yields and swings in a direction away from the oncoming paper according to the basis weight of the paper and properly guides the leading edge of the paper along the entrance baffle and into the fuser nip.

6. A guide system as set forth in claim 5 wherein the resilient member is a spring.

7. A guide system as set forth in claim 5 wherein the hinge member includes a mounting bar extending between spaced apart support elements of the printing apparatus;

wherein the self-adjusting guide member is rotatably received on the mounting bar; and wherein the resilient member includes a torsion spring extending between one end fixed to the self-adjusting guide member and an opposite end fixed to the mounting bar.

8. A guide system as set forth in claim 5 wherein the guide member has a front surface including the nose portion facing the oncoming paper and a rear surface facing away from the oncoming paper; and wherein the resilient member includes a compression spring extending between the frame of the printing apparatus and the rear surface of the guide member and maintaining the front surface of the guide member in the quiescent state.

9. A guide system as set forth in claim 5 including:

a minimal stop member for engagement by the self-adjusting guide member to define the minimal position, the resilient member urging the self-adjusting guide member into engagement with the minimal stop member; and a maximal stop member for engagement by the guide member to define the maximal position.

10. A guide system as set forth in claim 5 wherein the self-adjusting guide member has a generally planar front surface including the nose portion facing the oncoming paper; and wherein the entrance baffle has a generally planar front surface which is effectively a continuation of the front surface of the self-adjusting guide member throughout the range of swinging movement of the self-adjusting guide member between the minimal position and the maximal position.

* * * * *